US005157887A

United States Patent [19]

Watterworth, III

[11] Patent Number: 5,157,887

[45] Date of Patent: Oct. 27, 1992

[54] FIREPROOF STRUCTURAL ASSEMBLY

[76] Inventor: Kenneth R. Watterworth, III, 413 Sanford Rd., Southbury, Conn. 06488

[21] Appl. No.: 723,817

[22] Filed: Jul. 1, 1991

[51] Int. Cl.[5] ..... E04C 3/30

[52] U.S. Cl. ..... 52/721; 52/635; 52/340

[58] Field of Search ..... 52/721-723, 52/670-676, 452, 454, 353, 360, 340, 447, 635, 319

[56] References Cited

U.S. PATENT DOCUMENTS

| | | | |
|---|---|---|---|
| 915,295 | 3/1909 | Himmelwright | 52/340 |
| 1,484,524 | 2/1924 | Naugle | 52/360 |
| 1,821,015 | 9/1931 | Hull | 52/236.7 |
| 2,145,496 | 1/1939 | Reinhard | 52/353 |

FOREIGN PATENT DOCUMENTS

| | | | |
|---|---|---|---|
| 819531 | 9/1959 | United Kingdom | 52/452 |

*Primary Examiner*—James L. Ridgill, Jr.
*Attorney, Agent, or Firm*—Dallett Hoopes

[57] ABSTRACT

A structural assembly comprises a bar joist having ano utward flange along its base. Expanded metal lath is held in position agains the bars and above the flange by attachment clips. The attachment clips each comprise a U-shaped base which pinches the flange, a stem to hold the lath in place and a perpendicular end point which pokes through an opening in the lath to stabilize the clip. Finally, a thick layer of cementitious material adheres to the lath in the area of the bars and flange.

3 Claims, 1 Drawing Sheet

FIREPROOF STRUCTURAL ASSEMBLY

BACKGROUND OF THE INVENTION

1. Field of the Invention

This invention relates to a structural assembly including a bar joist or metal roof truss. More specifically, this invention relates to a bar joist having an expanded metal lath secured against it and a layer of cementitious material enclosing the structural elements of the bar joist and adhering to the lath to permit the joist to withstand fire temperatures without losing its strength. The invention also relates in such an environment to a clip for holding the lath against the joist members during the depositing of the cementitious layer.

2. Description of Related Art including Information Disclosed under §§1.97 to 1.99

Fireproofing of metal structures such as bar joists has been accomplished by depositing on the structural elements—the bars and flanges—an insulating material as described, for instance, in U.S. Pat. No. 4,584,811 to Balinski which issued Apr. 29, 1986. Fireproofing of bar joists in roof structures is necessary to prevent the loss of strength from overheating in a hot fire.

In the fireproofing process cementitious material is sprayed over the bar joist elements to a thickness of 2" or so to insulate them from the heat. The problem inherent in such a treatment process is that the bar joist, which comprises a number of zig-zag arranged bars running back and forth between upper and lower angles, is so open that it is difficult to make the material adhere to the elements. To solve this problem, fabricators and suppliers of material in the past have secured an expanded metal lath against the bar joist elements. This has usually been done by wiring the lath to the elements.

The wiring described above has been time and energy consuming. It has involved poking a wire through the lath, around the structural element, back through the lath and twisting the ends of the wire together. With such an assembly, the cementitious material is "caught" by the lath and held in position against the structural elements: little sprayed material passes through the lath to fall wastefully on the floor.

SUMMARY OF THE INVENTION

The present invention is the provision in such an environment of a new kind of clip which may be of stiff metal wire and comprises a U-shaped attachment at one end adapted to be slipped onto the flange of a bar joist. Extending upward from the U-shaped attachment is a stem which, in installation, rests against the expanded metal lath holding it securely against the bar elements. At the opposite ends from the U-shaped element the stem is provided with a perpendicular point which pokes through a selected opening in the expanded metal lath to stabilize the clip in proper position. The provision of the clip of the invention makes unnecessary the time-consuming wiring described above. Such clips may be placed frequently along the joist with their stem extending up from the bottom flange of the joist and down from the top flange.

BRIEF DESCRIPTION OF THE DRAWINGS

Further objects and features of the invention will be clear to those skilled in the art from the following description with reference to the drawings, all of which disclose a non-limiting embodiment of the invention. In the drawings.

DESCRIPTION OF THE PREFERRED EMBODIMENT

Figure 1:
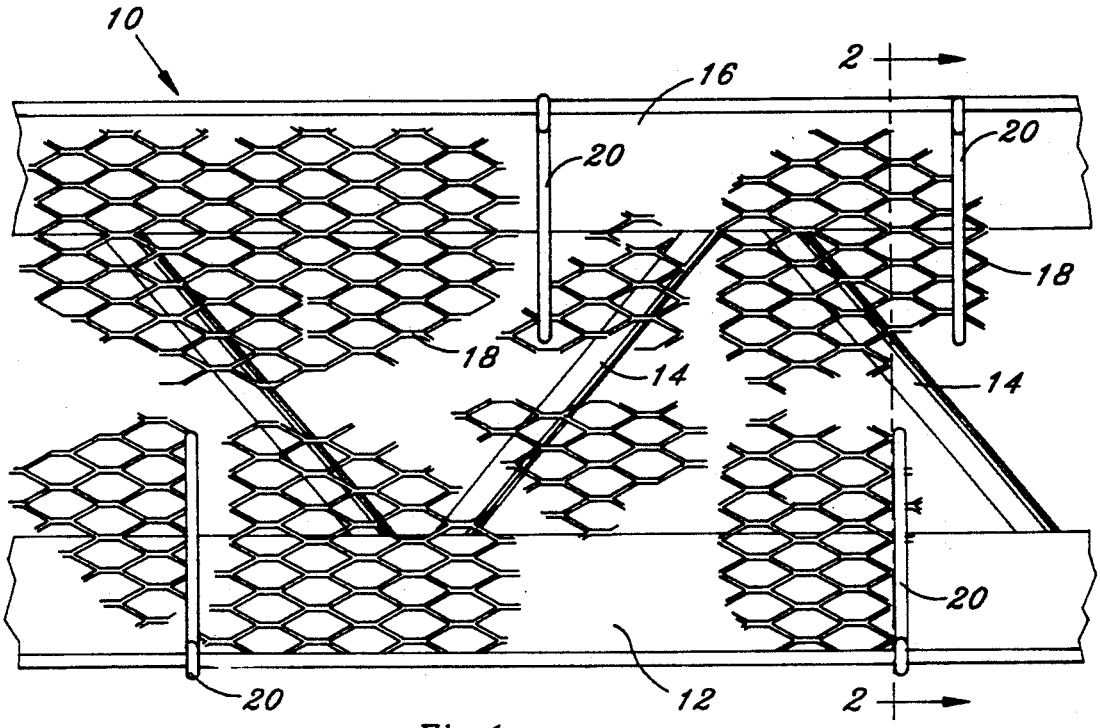
FIG. 1 shows a bar joist in front elevation having a lath of expanded metal secured against the elements by clips embodying the invention, the expanded metal lath being shown in fragmentary fashion.
Figure 2:
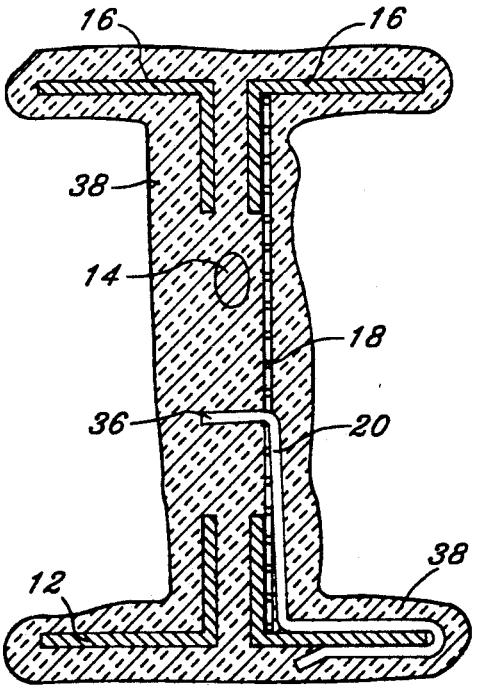
FIG. 2 is an enlarged sectional view taken on the line 2—2 of FIG. 1 with the cementitious material added.

A structural assembly embodying the invention is shown in FIG. 1 and generally designated 10. It comprises a pair of angles 12 (FIG. 2) which are secured back-to-back with the diagonal bar elements 14 welded inbetween. A second pair of angles 16 are secured to the opposite sides of the bar elements at the upper ends thereof (FIG. 2).

The structure thus far described is suitable for supporting a roof of metal or poured concrete construction.

In preparing the bar joist as described for spraying of fireproofing cementitious material, a sheet of expanded metal lath 18 is trimmed to the size between the lower and upper angles 12 and 16 and is positioned against a side of the diagonal bar elements 14. The purpose of the expanded metal lath is to receive the sprayed-on cementitious mixture so that the mixture, which otherwise would be sprayed through the openings between the bars and land on the floor, lands instead on the lath adjacent the bars and angles and builds up to the desired thickness.

Figure 3:
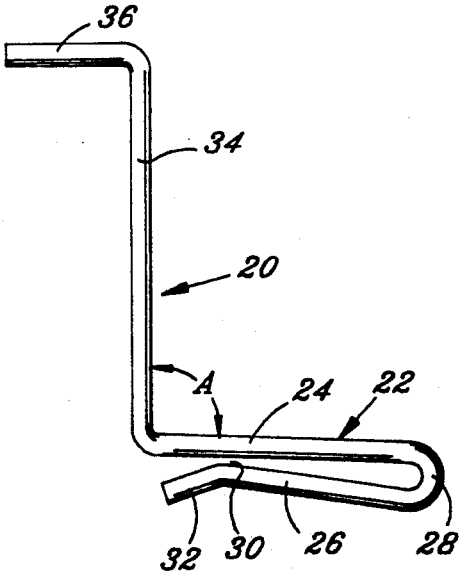
FIG. 3 is an enlarged side view of the clip.

For securing the lath 18 in position against the bar elements 14 prior to spraying, clips 20 are provided. As shown (FIG. 3), they each comprise a U-shaped base 22 defined by an upper leg 24 and a lower leg 26 joined by a U-shaped bight 28. At a point 30 spaced from the bight the legs 24, 26 touch or are very proximate. Forward of the point 30 the lower leg 26 may be deflected downward at 32 to provide a lead-in as will be described.

Extending upward from forward end of the upper leg 24 is the stem 34 which may bear an angle A of slightly greater than 90° with the leg 24. For instance, 92° has been found desirable. At its upper end, the stem 34 is provided with a perpendicular point 36.

In installation, the clip 20 is positioned so that its attachment base 22 lines up with a horizontal flange of the bar joist such as the flanges comprising the lower angles 12. The clip is then tapped on the bight 28, or merely pushed, so that its lead-in 32, engaging the edge of the flange, cams the attachment base open and so that the base slides smoothly over the flange and comes to rest (FIG. 2) with upper end of the stem 34 engaging the lath thereadjacent, the point 36 of the clip 20 extending through an opening in the lath to stabilize the clip.

Because the angle between the stem 34 and the upper leg 24 is slightly more than a right angle, the upper end of the stem exerts compressive force against the lath to hold it firmly against, or at least very proximate, the bar elements. If the clip 20 and the angle 12 are properly sized, the length of the upper leg 24 will comfortably accommodate the flange of the angle 12 so that the stem 34 rests against the expanded metal lath 18.

It will be understood that when a clip 20 is applied to one of the flanges of the upper angles 16, the stem will be directed downward with the point 36 extending through an opening below the top of the lath. The clips may be spaced along the bar joist at whatever frequency can effectively secure the lath in place without an extravagant number of clips being used.

Once the expanded metal lath is secured in place by the clips as described the cementitious mixture 38 may be sprayed directly at the area of the angles 12 and 16 and bar elements 14 because these are the structural elements which need fire protection. It is understood that the lath 18 is not a structural element. The spraying is accomplished in more than one coat to a final thickness which may approach 2".

In practice, the metal lath, which is used to facilitate the spray application of cementitious material on steel bar joists, may be ⅜" expanded steel lath, all as prescribed by UL in their fire-resistant directory. The clip 20 is preferably made of 0.125" diameter hard drawn wire shaped into a configuration shown in FIG. 3.

Applicant is aware that there are clips of somewhat comparable shape to that described and shown in the disclosure. An example is shown in U.S. Pat. No. 4,463,537 which issued Aug. 7, 1984 to Rodriquez et al. However, the wire clip shown herein and its position in the environment is totally new.

It will be clear to those skilled in the art that the invention represents an advance in that it sharply reduces the labor involved in preparation for the fireproofing spray procedure. The clip described is the preferred form and is simple and inexpensive and works well.

Reasonable variations on the shape of the clip are envisioned. It should be clear, therefore, that the invention is not limited to the embodiment shown and protection should be commensurate with the following claim language plus any extension of the right to exclude others from making, using or selling the invention as is proper by way of application of the doctrine of equivalents.

What is claimed is:

1. A structural assembly comprising (a) a metal bar joist including a plurality of spaced diagonal bars disposed in a vertical plane and a horizontally disposed metal base flange secured to the ends of the bars and extending horizontally outward therefrom, (b) a sheet of expanded metal lath disposed flat against the bars, (c) a one-piece step-shaped clip of stiff metal wire defined by:

1) a U-shaped attachment including generally horizontal and parallel inner and outer legs and a connecting bight therebetween, the legs straddling and pinching between them the base flange, 2) a stem extending along the expanded metal lath perpendicularly from the distal end of the inner leg and 3l) a point element perpendicular to the stem at its other end from the attachment and extending through an opening in the expanded metal lath to immobilize the clip, and (d) a layer of cementitious material covering the opposite sides of the bars and flange and extending through the expanded metal lath in the area of the bars.

2. A structural assembly as claimed in claim 1 wherein the end of the outer leg more remote from the bight is deflected downwardly to provide a lead-in to facilitate the installation of the attachment of the clip onto the flange.

3. A structural assembly as claimed in claim 1 wherein the stem and the distal end of the upper leg meet at an angle of about 92°.

* * * * *